United States Patent [19]

Pahl

[11] Patent Number: 4,922,608

[45] Date of Patent: May 8, 1990

[54] SHAVING APPARATUS WITH A PIVOTED SHEARING HEAD SYSTEM

[75] Inventor: Dietrich Pahl, Hofheim, Fed. Rep. of Germany

[73] Assignee: Braun Aktiengesellschaft, Kronberg, Fed. Rep. of Germany

[21] Appl. No.: 205,310

[22] Filed: Jun. 10, 1988

[30] Foreign Application Priority Data

Jun. 27, 1987 [DE] Fed. Rep. of Germany ..... 3721243

[51] Int. Cl.[5] ..... B26B 19/02

[52] U.S. Cl. ..... 30/43.91; 30/34.1; 30/43.1

[58] Field of Search ..... 30/43.1, 43.91, 43.3, 30/43.92, 34.1

[56] References Cited

U.S. PATENT DOCUMENTS 29,304 3/1987 Oprach .
2,232,717 2/1941 Moniet ..... 30/43.91
2,265,382 12/1941 Martin .
3,279,056 10/1966 Andis ..... 30/43.1
3,855,697 12/1974 Meyer .
4,481,711 11/1984 Pachel .

*Primary Examiner*—Douglas D. Watts
*Assistant Examiner*—Willmon Fridie, Jr.
*Attorney, Agent, or Firm*—Fish & Richardson

[57] ABSTRACT

The invention is directed to an electric shaving apparatus having a housing (1), a drive assembly and a shearing head (2) movable about a pivot axis (Z) and including an arcuate short hair cutter assembly (K) and a long hair cutter assembly (L) associated therewith.

The shearing head (2) is arranged to pivot about the pivot axis (Z) intermediate two support lugs (4,5) provided on the housing (1), such that by suitably positioning the pivot axis (Z) the entire shearing area usable for shaving is placed in contact with the skin surface and that the shearing area cannot become disengaged from the skin surface as the directions of sliding movement of the shearing head change.

16 Claims, 4 Drawing Sheets

SHAVING APPARATUS WITH A PIVOTED SHEARING HEAD SYSTEM

This invention relates to a dry shaving apparatus with a housing, a drive assembly and a shearing head including at least one arcuate short hair cutter assembly and at least one long hair cutter assembly associated therewith.

From German patent application DE-23 09 342 C2 a dry shaving apparatus is known which has a shaving head rigidly mounted on the housing and accommodating different hair cutting systems including a short hair cutting system and two long hair cutting systems in parallel arrangement with the short hair cutting system. If the operator of a shaving apparatus of this type wishes to use the short hair cutting system simultaneously with one of the long hair cutting systems provided, he is required to exercise great care in holding the two hair cutting systems in contact with the skin surface and its different contours in the cheek, chin and neck areas and guiding them over these areas. Such a relatively complicated and exacting shave making a shaving apparatus difficult to handle cannot be expected from the operator.

From EP 00 77 093 A2 a dry shaving apparatus is known having at least one screen shearing portion and comb shearing portion secured in the shearing head frame as well as an under cutter assembly coupled to the drive. In order to obtain simultaneous operation of screen shearing portion and comb shearing portion, the effective part of the comb shearing portion is connected with the effective part of the screen shearing portion in a laterally protruding fashion, with an obtuse angle being formed in the connection area of the two shearing portions by the plane determined by the effective part of the comb shearing portion and the tangential plane to the effective part of the screen shearing portion. To ensure simultaneous use of screen shearing portion and comb shearing portion, it is, however, necessary to guide the shaving apparatus always at a specific angle over the respective contour of the skin surface to prevent disengagement of one of the two shearing portions from the skin. Guiding the shaving apparatus over the contours of the skin surface with such precise accuracy makes handing of the shaving apparatus substantially more difficult, resulting as a rule in an unsatisfactory shave since experience has shown that the operator is generally not inclined to pay the necessary attention during the entire length of the shaving operation.

From U.S. Pat. No. 3,279,056 a shaving apparatus is known having two hair cutter systems of different configurations including a short hair cutter and a long hair cutter used independently of one another. In this arrangement, the short hair cutter and the long hair cutter are provided in relative parallel arrangement on the lateral flanges of a cutter head carrier which is mounted between two resilient bracket arms projecting from the shaver case and is pivotally carried by means of bearing trunnions engaged with the bracket arms, with the resilience of the bracket arms being selected such as to hold the cutter head carrier in any desired swivel position, in particular in either of the two extreme positions predetermined by stop means in which either of the hair cutter systems provided is expected to produce optimum cutting results. In this known shaver, simultaneous and continuous use of both hair cutter systems during a shave is not possible since the swivel bearing of the cutter head carrier is arranged a considerable distance below the engagement surfaces of the two hair cutter systems with the skin surface.

It is an object of the present invention to provide a shaving apparatus equipped with different hair cutter systems in which it is ensured that, with the shaver housing positioned relative to the skin surface at typical angles, at least one hair cutter system automatically engages the skin surface in combination with at least another hair cutter system of different configuration. that, with the directions of sliding movement of the shearing head over the skin surface changing. the hair cutter systems of different configurations engage the skin surface to a large extent, and that in at least one of the directions of sliding movement at least two of the hair cutter systems of different configurations operate simultaneously.

According to the present invention, this object is accomplished in a shaving apparatus of the type initially referred to by pivotally mounting the shearing head on the housing about a pivot axis Z extending in the longitudinal direction of the shearing head and by having the pivot axis Z extend through the point of intersection SP of two straight lines $G_1$ and $G_2$, where $G_1$ is a straight line applied to the outer edge of the long hair cutter assembly (L) as well as to the outer contour of an arcuate short hair cutter assembly (K), $G_2$ is a straight line intersecting the straight line $G_1$ at right angles in the center of the distance A, with A being the distance between the outermost tangency points $B_1$ and $B_2$ of the straight line $G_1$ tangent to both the long hair cutter assembly L and the short hair cutter assembly K.

In a device of the type initially referred to, this object is accomplished further by pivotally mounting the shearing head on the housing about a pivot axis Z extending in the longitudinal direction of the shearing head, by having the pivot axis Z extend in the neighboring range of the point of intersection SP of two straight lines $G_1$ and $G_2$, and by arranging the neighboring range above a connecting line V, where $G_1$ is a straight line applied to the outer edge of the long hair cutter assembly L as well as to the outer contour of a short hair cutter assembly K, $G_2$ is a straight line intersecting the straight line $G_1$ at right angles in the center of the distance A, with A being the distance between the outermost tangency points B and B of the straight line $G_1$ tangent to both the long hair cutter assembly L and the short hair cutter assembly K, and V being the connecting line between the lower limit point $P_1$, remote from the tangency point $B_1$, of the effective shearing area of the short hair cutter assembly K and the tangency point $B_2$.

The object of the invention is accomplished still further in a device of the type initially referred to by pivotally mounting the shearing head on the housing about a pivot axis Z extending in the longitudinal direction of the shearing head, by providing the short hair cutter assembly K intermediate two long hair cutter assemblies $L_1$ and $L_2$ in a protruding relationship to the long hair cutter assemblies, and by having the pivot axis Z extend through the point of intersection SP of two straight lines $G_3$ and $G_4$, where $G_3$ is a straight line applied to the outer edge of a long hair cutter assembly $L_1$ as well as to the outer contour of a short hair cutter assembly K, and $G_4$ is a straight line applied to the outer edge of a long hair cutter assembly $L_2$ as well as to the outer contour of a short hair cutter assembly K.

Moreover, in a further solution, a device of the type initially referred to provides for the shearing head to be pivotally mounted on the housing about a pivot axis Z extending in the longitudinal direction of the shearing head, for the short hair cutter assembly K to be provided intermediate two long hair cutter assemblies $L_1$ and $L_2$ in a protruding relationship to the long hair cutter assemblies, and for the pivot axis Z to extend in the neighboring range of the point of intersection SP of two straight lines $G_3$ and $G_4$, where $G_3$ is a straight line applied to the outer edge of a long hair cutter assembly $L_1$ as well as to the outer contour of a short hair cutter assembly K, and $G_4$ is a straight line applied to the outer edge of a long hair cutter assembly $L_2$ as well as to the outer contour of a short hair cutter assembly K.

Advantageous embodiments of the solutions set out in the foregoing are indicated in the subclaims related to these solutions. It is a particular advantage of the solutions set out that, within typical angles at which the shearing head of the shaving apparatus is usually held against the skin surface, both cutter assemblies of different configurations are automatically moved into engagement with the skin surface and remain engaged there during the length of the shave, regardless of the contact pressures they are subjected to and the changing directions of sliding movement of the shearing head over the skin surface, and further that in at least one of the directions of sliding movement at least two of the hair cutter assemblies of different configurations are in use simultaneously in the sense of performing a shearing operation.

Further advantages and details of the invention will become apparent from the subsequent description in conjunction with the drawings disclosing some preferred embodiments. Referring to the drawings, FIG. 1 is a perspective view of a shaving apparatus having a pivoted shearing head including different cutter assemblies;

Figure 1:
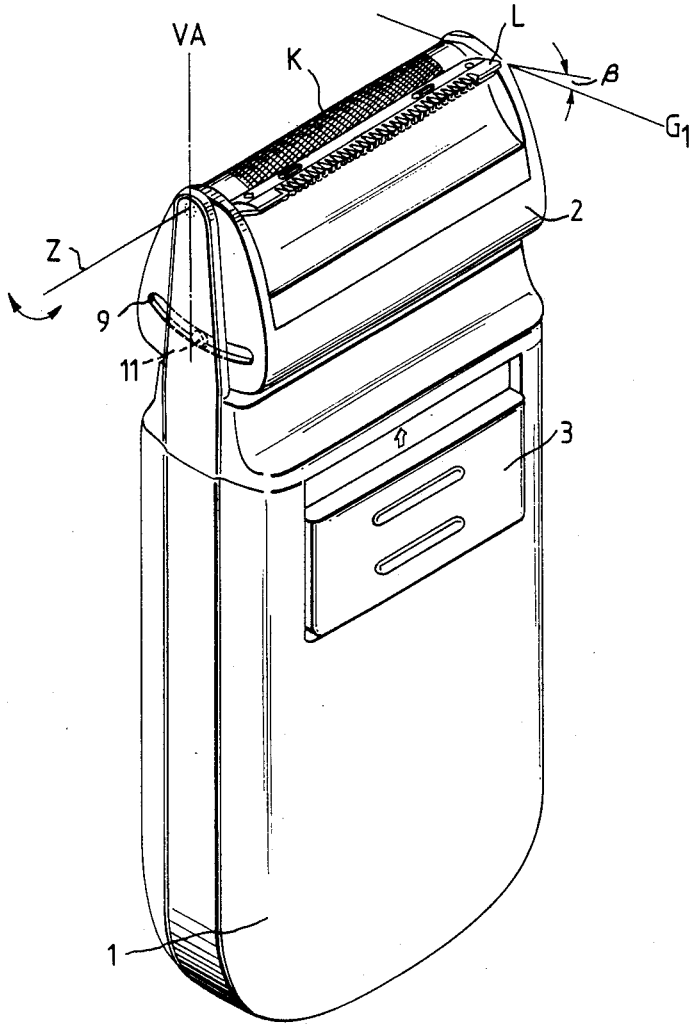

Referring now to FIG. 1 of the drawings, there is shown a shaving apparatus having a housing 1 accommodating an electric drive assembly adapted to be activated and deactivated by a switch 3 and a shearing head 2 pivoted about a pivot axis Z and including a short hair cutter assembly K as well as a long hair cutter assembly L associated therewith. VA identifies a vertical axis extending through the shearing head 2 which, as a symmetry axis, divides the shearing head into two parts of equal size. $G_1$ denotes a straight line applied to the outer edge of the inclined long hair cutter assembly L as well as to the outer contour of the short hair cutter assembly K, while, $\beta$ is the angular position of the long hair cutter assembly L relative to the straight line $G_1$. Further details of possible configurations of the shearing head 2, in particular its bearing, are shown in FIGS. 2 to 6.

Figure 2:
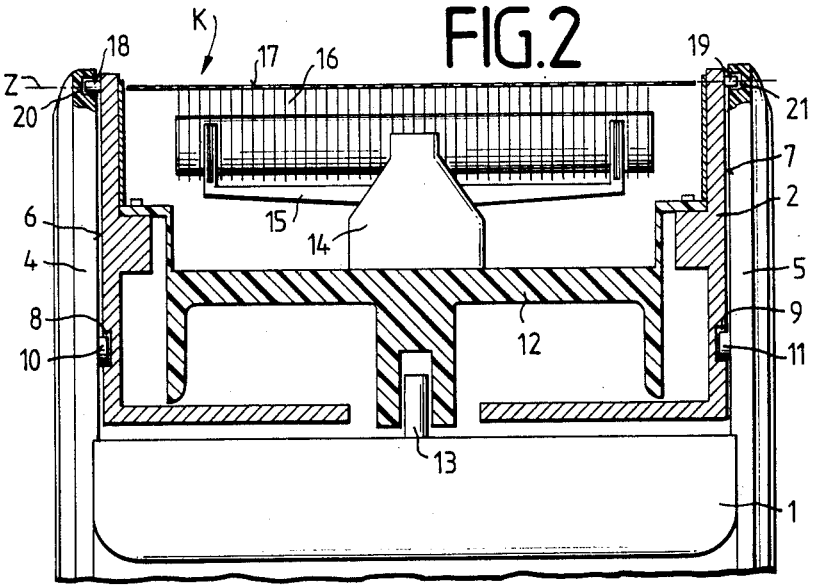
FIG. 2 is a longitudinal sectional view of a shearing head of FIG. 1 pivotally mounted on the housing of the shaving apparatus.

FIG. 2 is a longitudinal sectional view of the shearing head 2 and the upper part of the housing 1 of the shaving apparatus of FIG. 1. Provided on the housing 1 are two support lugs 4 and 5 between which the shearing head 2 is pivotally carried about the pivot axis Z. To limit the swivelling movement of the shearing head 2, guide grooves 8 and 9 are formed in the two narrow side walls 6 and 7, respectively, of the shearing head 2, for engagement by guide pins 10 and 11, respectively, provided on the support lugs 4 and 5, respectively. A vibratory bridge 12 is provided between and secured to the narrow side walls 6 and 7, the bridge being caused to oscillate in a reciprocating motion by a drive member 13 extending out of the housing 1. The vibratory bridge 12 is provided with a coupling means 14 for operating a long hair cutter assembly L not shown in addition to including a further coupling means 15 for operating a short hair cutter assembly K comprised of an under cutter 16 and an upper cutter 17. The shearing head 2 is pivoted about the pivot axis Z, being carried in bearing bores 20 and 21 in the support lugs 4 and 5, respectively, by means of two bearing pins 18 and 19, respectively, provided on the narrow side walls 6 and 7, respectively. The pivot axis Z extends level with the outer contour of the upper cutter of the short hair cutter assembly K through the center axes of the bearing bores 20 and 21 and the bearing pins 18 and 19. FIGS. 3 to 6 show schematically various embodiments and cooperative relationships of short and long hair cutter assemblies including the axis centers of the pivot axis Z.

Figure 3:
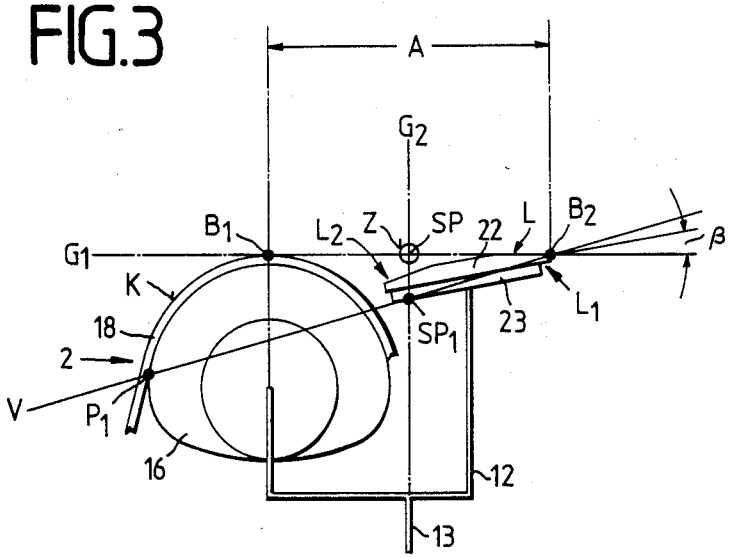
FIG. 3 is a schematic view of a shearing head having a short hair cutter assembly and an inclined long hair cutter assembly.

FIG. 3 shows an arcuate short hair cutter assembly K comprising an under cutter 16 and an upper cutter 17 as well as a long hair cutter assembly L including two cutting edges $L_1$ and $L_2$ and comprising a cutter comb 22 and a blade 23. $G_1$ identifies a straight line applied to the outer edge of the cutting edge $L_1$ of the inclined long hair cutter assembly L and tangent to the outer contour of the short hair cutter assembly K. A defines the distance between the outermost tangency points $B_1$ and $B_2$ of the straight line $G_1$ tangent to the short hair cutter assembly K and the long hair cutter assembly L. A straight line $G_2$ intersects the straight line $G_1$ at right angles in the center of the distance A, providing the point of intersection SP.

The point of intersection SP represents the center of the pivot axis Z of the shearing head 2 pivotally mounted on the housing 1 in the longitudinal direction, this center serving as reference point for the neighboring range within which the pivot axis Z may also be provided. The arcuate short hair cutter assembly K includes an effective shearing area which, starting from the tangency point $B_1$, extends in either direction on the arc length, terminating at the limit point $P_1$ on the side of the arc remote from the long hair cutter assembly L. In limit point $P_1$, the under cutter 16 and the upper cutter 17 are still active in the sense of shearing or can still be used in this sense on account of their cuttable relative engagement. A connecting line V interconnecting the limit point $P_1$ and the tangency point $B_2$ intersects the straight line $G_2$. The resulting point of intersection $SP_1$ serves, in conjunction with the point of intersection SP of the straight lines $G_1$ and $G_2$, as reference point for the distance C which is the determining factor for an arrangement of the pivot axis Z above and below the straight line $G_1$.

The long hair cutter assembly L is arranged in the pivoted shearing head 2 at a predetermined angle $\beta$ to the straight line $G_1$. The angular range of $\beta$ is preferably between 5° and 25°. Arranging the long hair cutter assembly L in an inclined position relative to the straight line $G_1$ and thus relative to the short hair cutter assembly K produces a bow wave effect of the skin to be shaved, with the result that the skin surface is in particularly close engagement with both cutter assemblies which are thus put to use simultaneously in an optimum manner in the sense of effecting a shearing action.

In FIG. 3, like in FIGS. 4 to 6, the vibratory bridge 12 and the drive member 13 described with reference to FIG. 2 and causing both the under cutter 16 and the blade 23 to oscillate in a reciprocating motion are illustrated in simplified form by a U-shaped yoke and a thick line, respectively.

Figure 4:
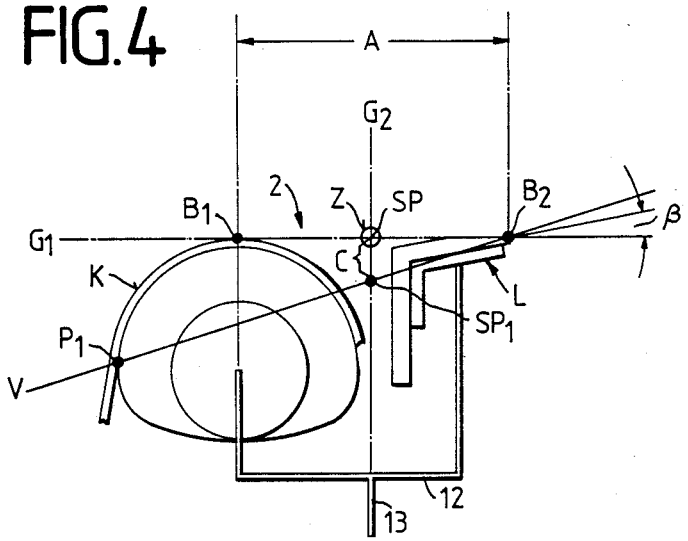
FIG. 4 is a schematic view of a shearing head having a short hair cutter assembly and a single-edge long hair cutter assembly.

The embodiment of FIG. 4 shows a shearing head 2 pivoted about the pivot axis Z and comprising an arcuate short hair cutter assembly K and a long hair cutter assembly L arranged at an angle $\beta$ relative to the straight line $G_1$, the long hair cutter assembly L having only one cutting edge $L_1$ provided opposite the short hair cutter assembly K. The pivot axis Z extends through the point of intersection SP of the straight lines $G_1$ and $G_2$, with the straight line $G_2$ intersecting the straight line $G_1$ at right angles and in the center of the relative distance A of the tangency point $B_1$ to the tangency point $B_2$. The tangency points $B_1$ and $B_2$ are obtained by applying the straight line $G_1$ to the outer contours of the arcuate short hair cutter assembly K and the long hair cutter assembly L, with the tangency point lying remotest from the tangency point $B_1$ being considered the tangency point $B_2$ in embodiments in which the straight line $G_1$ has surface contact with the long hair cutter assembly.

Figure 5:
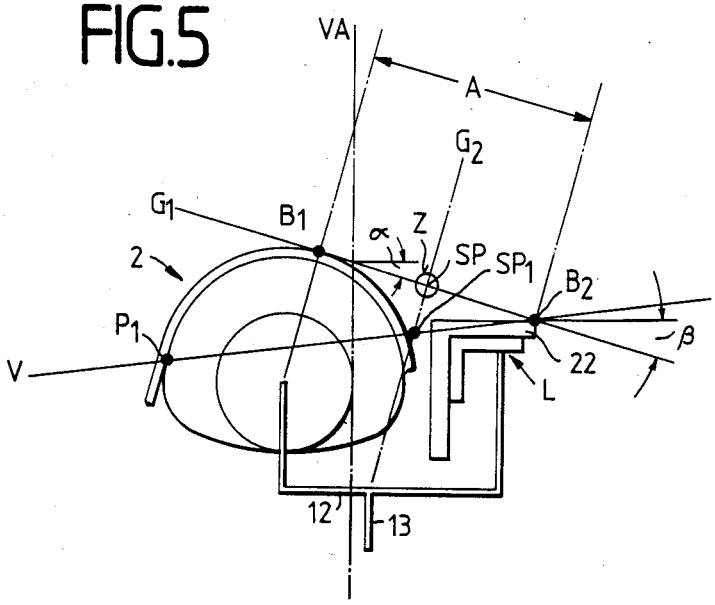
FIG. 5 is a schematic view of a shearing head having a long hair cutter assembly arranged in a vertically offset relationshp to the short hair cutter assembly.

In the embodiment of FIG. 5, the shearing head 2 is in a middle position of its swivelling range as shown, for example, in FIG. 1. The long hair cutter assembly L provided with only one cutting edge $L_1$ is arranged in the shearing head 2 at a lower elevation relative to the outer contour of the short hair cutter assembly K, whereby the straight line $G_1$ applied to the outer contour of the short hair cutter assembly K and to the outer edge of the long hair cutter assembly L intersects the vertical axis VA at an angle $\alpha$. By aligning the upper side surface of the cutter comb 22 horizontally or at right angles to the vertical axis VA, the comb extends at an angle $\beta$ relative to the straight line $G_1$. Accordingly, angles $\alpha$ and $\beta$ are of identical magnitude in this embodiment. Such identity is, however, not an absolute requirement because the upper side surface of the cutter comb 22 may be aligned relative to the straight line $G_1$ in a position different from the one shown and, accordingly, assume an angular position different from angle $\alpha$.

The shearing head 2 of FIG. 5 is pivoted about the pivot axis Z which extends through the point of intersection SP of the straight line $G_1$ with the straight line $G_2$ which intersects $G_1$ at right angles in the center of the distance A. The cooperative relation of the vertically offset long hair cutter assembly L with the short hair cutter assembly K as shown and described herein is particularly conducive to a close engagement of both cutter assemblies of the shearing head with the skin surface, producing a bow wave effect of the skin to be shaved as a result of which a substantially larger area of the skin is effectively exposed to shearing.

Figure 6:
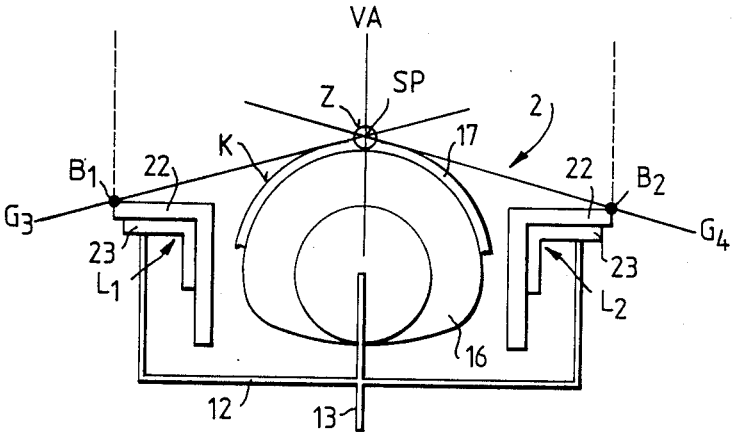
FIG. 6 is a view of a shearing head having a short hair assembly arranged intermediate two long hair cutter assemblies.

In the embodiment of FIG. 6, the shearing head 2 is pivoted about a pivot axis Z extending in the longitudinal direction of the shearing head. The arcuate short hair cutter assembly K is provided intermediate two long hair cutter assemblies $L_1$ and $L_2$ in a protruding relationship thereto. The blades 23 of the long hair cutter assemblies $L_1$ and $L_2$ as well as the under cutter 16 of the short hair cutter assembly K are coupled to the drive assembly of the dry shaving apparatus via the vibratory bridge 12 and the drive member 13 illustrated schematically. In this embodiment, the pivot axis Z of the shearing head 2 extends through the point of intersection SP of two straight lines $G_3$ and $G_4$, where $G_3$ is a straight line applied to the outer edge of the long hair cutter assembly $L_1$ and to the outer contour of the short hair cutter assembly K, and $G_4$ is a straight line applied to the outer edge of the long hair cutter assembly $L_2$ and to the outer contour of the short hair cutter assembly K. The point of contact of the straight line $G_3$ with the outer edge of the long hair cutter assembly $L_1$ is identified by tangency point $B_1$ while the point of contact of the straight line $G_4$ with the outer edge of the long hair cutter assembly $L_2$ is identified by tangency point $B_2$. As becomes apparent from this FIG., the pivot axis Z extending through the point of intersection SP in the longitudinal direction of the shearing head 2 intersects the vertical axis VA. In the embodiment of FIG. 6, the symmetrical arrangement of the two long hair cutter assemblies $L_1$ and $L_2$ relative to the short hair cutter assembly K provided intermediate thereof ensures that one of the long hair cutter assemblies $L_1$ or $L_2$ operates in combination with the short hair cutter assembly K in any direction of sliding movement of the shearing head 2 over the skin to be shaved.

The pivot axis Z of the movable shearing head 2 may be provided within a neighboring range around the point of intersection SP, this arrangement ensuring that the entire shearing area usable for shaving is placed in contact with the skin while the shaver housing is held against the skin at typical angles, and that the shearing area or part of the usable shearing area does not become disengaged from the skin surface as the directions of sliding movement of the shearing head over the skin surface change. It is understood that an arrangement of the pivot axis Z in the neighborhood of the point of intersection SP requires that practical considerations be taken into account. In view of the influence variables to be considered including, for example, the arcuate contour of the short hair cutter assembly K, the angular position $\beta$ of the long hair cutter assembly or assemblies L relative to the straight line $G_1$, the relative distance C of the point of intersection SP of the straight line $G_1$ with the straight line $G_2$ to the point of intersection $SP_1$ of the straight line $G_2$ with the connecting line V, the amount of friction of short and long hair cutter assemblies relative to the skin surface and the area of the contact pressures exerted by the shaving apparatus on the skin surface, the limits of a permissible relative distance of the pivot axis Z to the point of intersection SP can only be determined by practical tests for the individual embodiments concerned. Starting from the straight line $G_1$, the neighboring range may cover the area below the straight line G up to about half the distance C which is predetermined by the point of intersection SP of the straight lines $G_1$ and $G_2$ and the point of intersection $SP_1$ of the straight line $G_2$ with the connecting line V, while above the straight line $G_1$ it may extend up to about ten times the distance C defined in the foregoing. With due consideration of the influence variables identified above, it is also possible to shift the pivot axis Z from the straight line $G_2$ by an amount x either in the direction of the tangency point $B_2$ on the straight line $G_1$ or below or above the straight line $G_1$.

Figure 7:
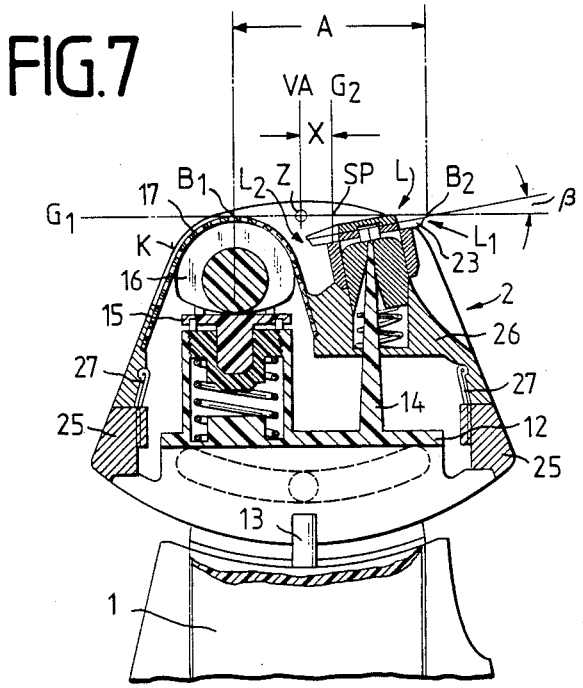
FIG. 7 is a cross sectional view of the shearing head of FIGS. 1 and 2.

A practical embodiment in which the pivot axis Z of the shearing head 2 is shifted from the straight line $G_2$ and thus from the point of intersection SP in the direction of the tangency point $B_1$ on the straight line $G_1$ is illustrated in FIG. 7 and will be explained in more detail in the following. FIG. 7 is a cross sectional view of the shearing head 2 and the upper part of the housing 1 of the shaving apparatus of FIGS. 1 and 2.

An exchangeable frame 26 is seated on shoulders 25 of the shearing head housing, which shoulders extend in the longitudinal direction of the shearing head 2, where it is removably held in position by means of springs 27. An upper cutter 17 consists of a shearing foil arched over and secured to the exchangeable frame 26. Parallel to the upper cutter 17, a long hair cutter assembly L including two cutting edges $L_1$ and $L_2$ is arranged in the exchangeable frame as a constituent part thereof. The long hair cutter assembly L is coupled to a coupling means 14 formed integrally with the vibratory bridge 12. The long hair cutter assembly L is configured as a double-edge cutter $L_1$, $L_2$ positioned at an angle $\beta$ to the straight line $G_1$. The under cutter 16 which is comprised of an arcuate cutter block is also coupled to the vibratory bridge 12 by a coupling means 15, the bridge being caused to oscillate by a drive member 13 extending out of the housing 1, the oscillating motion being transmitted via the coupling means 15 and 14 to the under cutter 16 and, respectively, the blade 23 of the two cutter assemblies.

A represents the distance between the outermost tangency points $B_1$ and $B_2$ of the straight line $G_1$ tangent to the short hair cutter assembly K and the long hair cutter assembly L, while $G_2$ identifies a straight line intersecting the straight line $G_1$ at right angles in the center of the distance A. The point of intersection of the straight lines $G_1$ and $G_2$ is identified by SP. In this embodiment, the pivot axis Z of the shearing head 2 is shifted in the direction of the tangency point $B_1$ by an amount x from the straight line $G_2$ or from the point of intersection SP, with the pivot axis Z intersecting the straight line $G_1$. As described with reference to and shown in FIG. 2, the pivot axis Z is identical with the center axes of the bearing pins 18 and 19 by means of which the shearing head 2 is pivotally carried in the respective bearing bores 20 and 21 of the respective support lugs 4 and 5. In FIG. 7, the symmetry axis through the shearing head 2 is shown as the vertical axis VA. The amount x by which the pivot axis is shifted from the straight line $G_2$ in the direction of the tangency point $B_1$ is identical to the relative distance of the vertical axis VA to the straight line $G_2$ on the straight line $G_1$. Accordingly, the pivot axis Z extends through the point of intersection of the straight line $G_1$ with the vertical axis VA which results in a particularly well balanced swivelling motion of the shearing head 2. In consequence, the pivot axis Z is preferably shifted from the straight line $G_2$ in the direction of the vertical axis VA of a shearing head 2.

We claim:

1. A dry shaving apparatus comprising a housing, a drive assembly and a shearing head including at least one arcuate short hair cutter assembly and at least one long hair cutter assembly associated therewith, said shearing head being pivotally mounted on said housing about a pivot axis (Z) extending in the longitudinal direction of said shearing head, said pivot axis (Z) extending through the point of intersection (SP) of two straight lines ($G_1$, $G_2$), where $G_1$ is a straight line applied to the outer edge of said long hair cutter assembly as well as to the outer contour of said arcuate short hair cutter assembly, $G_2$ is a straight line intersecting said straight line ($G_1$) at right angles in the center of the distance (A), and A is the distance between the outermost tangency points ($B_1$, $B_2$) of said straight line ($G_1$) tangent to both said long hair cutter assembly and said short hair cutter assembly.

2. A shaving apparatus comprising a housing, a drive assembly and a shearing head including at least one arcuate short hair cutter assembly and at least one long hair cutter assembly associated therewith whose cutting area ($L_1$) on the side remote from said short-hair cutter assembly includes an angular outer edge, said shearing head being pivotally mounted on said housing about a pivot axis (Z) extending in the longitudinal direction of said shearing head, said axis (Z) extending in the neighboring range of the point of intersection (SP) of two straight lines ($G_1$, $G_2$), and said neighboring range lying above a connecting line (V), where $G_1$ is a straight line applied to the outer edge of said long hair cutter assembly as well as to the outer contour of said short hair cutter assembly (K), $G_2$ is a straight line intersecting said straight line ($G_1$) at right angles in the center of the distance (A), with A being the distance between the outermost tangency points ($B_1$, $B_2$) of said straight line ($G_1$) tangent to both said long hair cutter assembly and said short hair cutter assembly, and V being the connecting line between the lower limit point ($P_1$), remote from the tangency point ($B_1$), of the effective shearing area of said short hair cutter assembly and the tangency point ($B_2$).

3. A dry shaving apparatus as claimed in claim 1 or claim 2, characterized in that in the middle position of the pivoted shearing head (2) the straight line ($G_1$) intersects a vertical axis (VA) extending through the shearing head (2) at right angles.

4. A dry shaving apparatus as claimed in claim 1 or claim 2, characterized in that in the middle position of the pivoted shearing head (2) the straight line ($G_1$) intersects a vertical axis (VA) extending through the shearing head (2) at a predetermined angle ($\alpha$).

5. A dry shaving apparatus as claimed in either claim 1 or claim 2, characterized in that the long hair cutter assembly (L) is configured as a single-edge cutter ($L_1$).

6. A dry shaving apparatus as claimed in either claim 1 or claim 2 wherein said long hair cutter assembly has two cutting edges ($L_1$, $L_2$).

7. A dry shaving apparatus as claimed in either claim 1 or claim 2 characterized in that the long hair cutter assembly (L) is aligned relative to the straight line ($G_1$) at a predetermined angle ($\beta$) between 5° and 25°.

8. A dry shaving apparatus as claimed in claim 2 characterized in that the pivot axis (Z) is provided at a distance (x) to the straight line ($G_2$).

9. A dry shaving apparatus as claimed in claim 8, characterized in that the pivot axis (Z) is provided at a distance (x) to the straight line ($G_2$), said distance being determined by the relative distance of the straight line ($G_2$) to the vertical axis (VA).

10. A dry shaving apparatus as claimed in either claim 1 or 2, characterized in that the cutters of the short hair cutter assembly (K) and of the long hair cutter assembly ($L_1$, $L_2$) are jointly coupled to the drive assembly of the shaving apparatus via a coupling block carried in the shearing head.

11. A dry shaving apparatus as claimed in either claim 1 or 2, characterized in that the shearing head (2) is pivoted about the pivot axis (Z) intermediate two support lugs (4, 5) provided on the housing (1).

12. A dry shaving apparatus as claimed in either claim 1 or 2, characterized in that the pivot axis (Z) intersects the vertical symmetry axis (V) at right angles.

13. A dry shaving apparatus comprising a housing, a drive assembly and a shearing head including at least one arcuate short hair cutter assembly and two long hair cutter assemblies associated therewith, said shearing head being pivotally mounted on said housing about a pivot axis (Z) extending in the longitudinal direction of said shearing head, said short hair cutter assembly being provided intermediate said two long hair cutter assemblies in a protruding relationship to said long hair cutter assemblies, and said pivot axis (Z) extending through the point of intersection (SP) of two straight lines ($G_3$, $G_4$), where $G_3$ is a straight line applied to the outer edge of one long hair cutter assembly as well as to the outer contour of said short hair cutter assembly, and $G_4$ is a straight line applied to the outer edge of the other long hair cutter assembly as well as to the outer contour of said short hair cutter assembly.

14. A dry shaving apparatus comprising a housing, a drive assembly and a shearing head including a t least one arcuate short hair cutter assembly and two long hair cutter assemblies associated therewith, said shearing head being pivotally mounted on said housing about a pivot axis (Z) extending in the longitudinal direction of said shearing head, said short hair cutter assembly being provided intermediate said two long hair cutter assemblies in a protruding relationship to said long hair cutter assemblies, and said pivot axis (Z) extending in the neighboring range of the point of intersection (SP) of two straight lines ($G_3$, $G_4$), where $G_3$ is a straight line applied to the outer edge of one long hair cutter assembly as well as to the outer contour of said short hair cutter assembly, and $G_4$ is a straight line applied to the outer edge of the other long hair cutter assembly as well as to the outer contour of said short hair cutter assembly.

15. A dry shaving apparatus as claimed in either claim 13 or 14, characterized in that the shearing head (2) is pivoted about the pivot axis (Z) intermediate two support lugs (4, 5) provided on the housing (1).

16. A dry shaving apparatus as claimed in either claim 13 or 14, characterized in that the pivot axis (Z) intersects the vertical symmetry axis (VA) at right angles.

* * * * *